US008607364B2

(12) United States Patent
Barski

(10) Patent No.: US 8,607,364 B2
(45) Date of Patent: Dec. 17, 2013

(54) ERGONOMIC SWADDLING GARMENT

(76) Inventor: Karen H. Barski, Trumbull, CT (US)

( * ) Notice: Subject to any disclaimer, the term of this patent is extended or adjusted under 35 U.S.C. 154(b) by 808 days.

(21) Appl. No.: 12/798,590

(22) Filed: Apr. 7, 2010

(65) Prior Publication Data

US 2013/0139290 A1 Jun. 6, 2013

Related U.S. Application Data

(63) Continuation-in-part of application No. 12/378,329, filed on Feb. 14, 2009, now abandoned.

(51) Int. Cl.
*A41B 13/06* (2006.01)

(52) U.S. Cl.
USPC ..... 2/69.5; 2/69; 2/111; 2/75; 2/80

(58) Field of Classification Search
USPC ..... 2/69, 69.5, 70, 75, 80, 83, 111
See application file for complete search history.

(56) References Cited

U.S. PATENT DOCUMENTS

| | | | | |
|---|---|---|---|---|
| 1,159,788 | A | | 11/1915 | Newbell |
| 1,241,699 | A | | 10/1917 | Barnes |
| 1,940,224 | A | | 12/1933 | Munro |
| D122,883 | S | | 10/1940 | Doesburg |
| D127,525 | S | | 5/1941 | Segerman |
| 2,242,130 | A | | 5/1941 | Hutchison |
| 2,431,603 | A | | 11/1947 | Zito |
| 2,478,765 | A | | 8/1949 | Kim |
| 2,521,609 | A | | 9/1950 | Segerman |
| 2,537,537 | A | | 1/1951 | Ljungberg |
| 2,578,323 | A | * | 12/1951 | Sillaway ..... 2/69.5 |
| 2,579,276 | A | | 12/1951 | Schworm, Jr. |
| 2,651,781 | A | | 9/1953 | Buchholz |
| 2,680,849 | A | * | 6/1954 | Munro ..... 2/69.5 |
| 2,931,043 | A | | 7/1957 | Achner |
| 3,485,241 | A | | 12/1969 | Polley |
| 3,555,567 | A | * | 1/1971 | Owen ..... 2/69.5 |
| D296,378 | S | | 6/1988 | Coates |
| 4,773,101 | A | | 9/1988 | Kapp et al. |
| 5,058,208 | A | * | 10/1991 | Adams ..... 2/80 |
| D353,034 | S | | 12/1994 | Panza et al. |
| 5,640,717 | A | | 6/1997 | Ray |
| D384,188 | S | | 9/1997 | Imm |
| 5,826,287 | A | | 10/1998 | Tandrup |
| 6,393,612 | B1 | * | 5/2002 | Thach et al. ..... 2/69.5 |
| D487,836 | S | | 3/2004 | Cowdin |
| 6,817,048 | B1 | | 11/2004 | LaRosa |
| 6,978,479 | B2 | | 12/2005 | Thach |

(Continued)

*Primary Examiner* — Alissa Tompkins
(74) *Attorney, Agent, or Firm* — Mark P. Stone

(57) ABSTRACT

Ergonomic garment for swaddling an infant garment with an elongate retractable fabric shell having an outer surface and inner surface defining an interior volume for receiving the arms, legs and trunk of an infant therein. Garments have a head end for receiving the arms of said infant, a foot end for receiving the legs of said infant, and a mid section for receiving the trunk of said infant that is narrower than said head end and said foot end, and a neck opening at the head end for receiving a neck of said infant. Garments have an ergonomic peanut-like shape. Garments have a reversible closure means accessing said interior volume of said fabric shell extending longitudinally along the central axis of said fabric shell from said head end to said foot end, a chin protector closure means and optionally a means for accepting an automotive seat belt. Detachable arms and/or leggings and attached retractable arms and/or leggings garments are shown. Porous light-permeable and antimicrobial fabric embodiments are described.

8 Claims, 11 Drawing Sheets

(56) References Cited

U.S. PATENT DOCUMENTS

| | | | |
|---|---|---|---|
| D513,357 | S | 1/2006 | Allard |
| 6,981,282 | B2 | 1/2006 | Marty et al. |
| D526,464 | S | 8/2006 | Johnson et al. |
| D537,235 | S | 2/2007 | Hope |
| 7,246,392 | B2 | 7/2007 | Schmid et al. |
| 7,254,849 | B1 | 8/2007 | Fiebrich et al. |
| D557,880 | S | 12/2007 | O'Connor-Cowley |
| 7,409,726 | B2 | 8/2008 | Bahm et al. |
| D606,282 | S | 12/2009 | Chen |
| 7,673,354 | B2 | 3/2010 | Fader |
| 7,774,875 | B1 | 8/2010 | Zeidman |
| D633,278 | S | 3/2011 | de Bourgknecht |
| 7,954,187 | B1 | 6/2011 | Earnest |
| D644,413 | S | 9/2011 | Keall et al. |
| D654,248 | S | 2/2012 | Abrams et al. |
| 8,191,188 | B2 | 6/2012 | Kaplan et al. |
| D668,020 | S | 10/2012 | Wimer |
| 2005/0120459 | A1 | 6/2005 | McConnell et al. |
| 2007/0044199 | A1 | 3/2007 | Ebert |
| 2007/0061968 | A1 | 3/2007 | Fader |
| 2009/0064390 | A1 | 3/2009 | Beiring et al. |
| 2009/0222968 | A1 | 9/2009 | Pisano-Ginter |
| 2010/0218299 | A1 | 9/2010 | Damir |
| 2010/0218314 | A1 | 9/2010 | Mulheron |
| 2010/0229277 | A1 | 9/2010 | Lang |
| 2010/0257654 | A1 | 10/2010 | Waters et al. |
| 2012/0110716 | A1 | 5/2012 | Christensen et al. |
| 2012/0125347 | A1 | 5/2012 | Soileau |
| 2012/0311762 | A1 | 12/2012 | Aiken et al. |

* cited by examiner

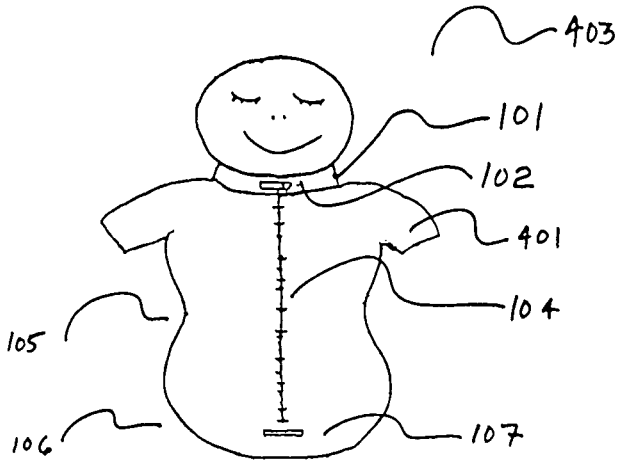
FIG. 4A
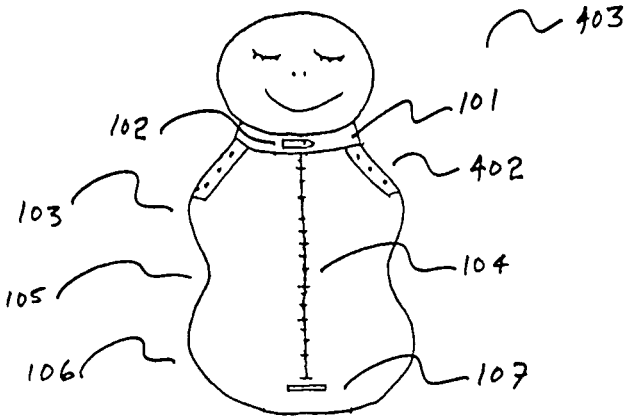
FIG 4B
FIG. 4

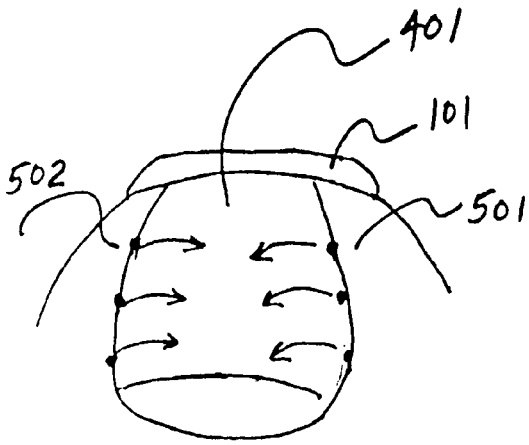
FIG 5A
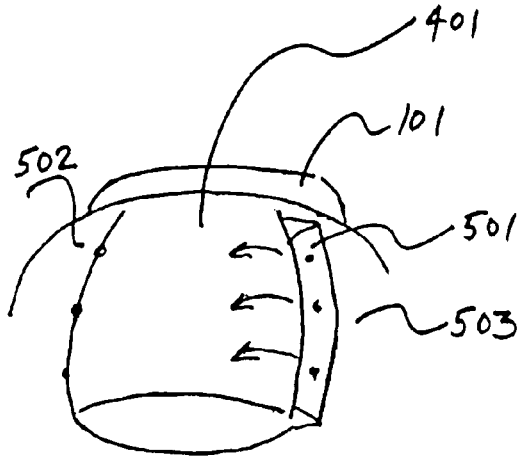
FIG. 5C
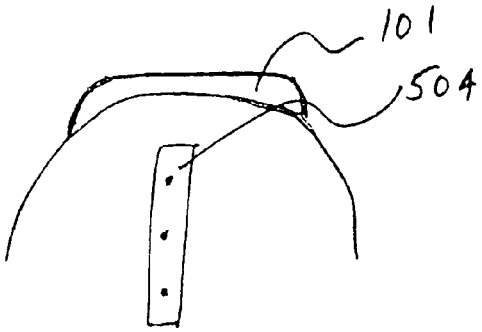
FIG. 5B
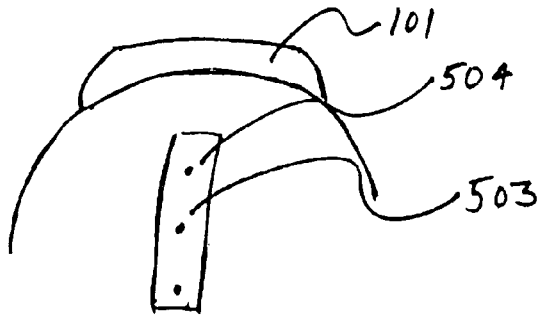
FIG. 5D
FIG 5

ERGONOMIC SWADDLING GARMENT

This application is a continuation-in-part of U.S. patent application having Ser. No. 12/378,329 filed Feb. 14, 2009 ABN.

BACKGROUND OF THE INVENTION

1. Field of the Invention

The present invention relates to infant garments. More particularly, the present invention relates to novel garments for swaddling an infant that are flexible, conveniently employed, and provides safety, comfort, and security to infants 2. Description of the Prior Art By way of background swaddling refers to the longtime practice of wrapping infants tightly. Swaddling attempts to provide comfort and security to newborns by mimicking the environment of the womb that the infants experienced during the gestation period. Swaddling has been proven to promote restful sleep and security to infants. However, in spite of the longstanding practice of swaddling infants, there are limitations with current designs. For example, many current swaddling garments use Velcro® closures which lose their durability over time, and as infants grow stronger at two or three months of age, they stretch and the Velcro® closures pop open. Perhaps the most common method of swaddling infants involves wrapping infants in blankets of various designs, including four-sided receiving blankets. Swaddling with such blankets is limited in that they tend to unravel, especially when attempted by new parents who are not experienced with swaddling.

Over time, a wide variety of swaddling sleeper garments, infants wraps, pouches, buntings, and swaddling blankets have been proposed, including U.S. Pat. Nos. 1,940,224; 2,431,603; 2,521,609; 2,579,276; 6,817,048; D296,378; 6,393,612; D513,357; and 7,254,849. Antimicrobial fabrics are disclosed in U.S. Pat. Nos. 6,780,799 and 7,232,777.

While conventional use of receiving blankets and other swaddling garment designs are useful, it becomes increasingly difficult to keep infants tightly swaddled as the infants grow and are able to push with their arms or kick thereby freeing themselves or appendages from the garments or loosening the garments to a point where the swaddling function is useless or severely compromised.

There is a need for a means of overcoming the problems, limitations and disadvantages of known and conventional swaddling blankets and garments and maintaining tight swaddling garment functionality. Also, there is a need for multifunctional garments to provide swaddling and simultaneously provide either arm movement or leg movement.

Accordingly, it is an object of the present invention to provide a new and improved swaddling garment that imitates the physical environment of the womb.

Another object of the present invention is to provide a swaddling garment that is safe and easy to use.

Yet another object of the present invention is to provide a swaddling garment that is ergonomically designed.

These and other objects and advantages of the present invention and equivalents thereof, are achieved by an ergonomically designed swaddling garment that is easily opened and closed for convenient use with infants.

Still another object of the invention is to provide garments providing swaddling in concert with either arm movement or leg movement.

SUMMARY OF THE INVENTION

The present invention is directed to a novel swaddling garment for infants having a novel ergonomic design for providing maximal comfort, effectiveness, safety and easy of use.

The present invention discloses a swaddling garment designed with ergonomic principles. The garments disclosed are preferably constructed with two-way or four way stretch fabric, have a novel peanut-like shape that provides precise material physical forces containing infants' arms, legs and midsection while providing optimal swaddling, have a convenient zipper for infant entry and exit, have chin protector closure, and optionally have any suitable seatbelt accepting means, including but not limited to slits or loops.

In a preferred embodiment, the ergonomic swaddling garments of the invention utilize a four-way stretch fabric comprised of about 94 wt % cotton and about 6 wt % spandex with sizing proportional to variable infant dimensions.

The ergonomic swaddling garment of the invention comprises an elongate fabric shell that has an outer surface and inner surface opposite the outer surface defining an interior volume for receiving the arms, legs and trunk of an infant therein. The shell has a head end for receiving the arms of said infant, a foot end opposite said head end for receiving the legs of an infant, and a mid section between the head end and the foot end for receiving the trunk of an infant that is narrower than the head end and the foot end, and a neck opening at the head end for receiving a neck of an infant; a reversible closure means accessing the interior volume of the fabric shell extending longitudinally along the central axis of the fabric shell from the head end to the foot end; a chin protector having a closure means at the head end terminus of the closure means; and optionally a means for accepting an automotive seat belt.

The swaddling garment of the invention has a closure means selected from the group consisting of zippers, hook and loop closures, and snap closures, but a preferred closure means is a zipper. The swaddling garment has a chin protector closure means selected from the group consisting of: toggle closures, hook and loop closures, elastic, and snap closures.

The invention swaddling garment according has a shell that is stretch fabric. The stretch fabric shell may be two-way or four-way elasticized stretch fabric selected from the fabric groups consisting of: nylons, rayons, spandex, polyesters, cottons, linens, canvas, wools, heat conductive fabrics, porous light-permeable fabrics, antimicrobial fabrics, and combinations or blends thereof. Light-permeable fabrics preferably permit 50-99% light penetration. The invention swaddling garment, has preferably a fabric shell of stretch fabric of cotton in an amount from about 50 wt % to about 98 wt and spandex in an amount from about 2 wt % to about 98 wt %; more preferably the fabric shell is four-way stretch fabric of 92 to 94 wt % cotton and from about 5 to 8% 6 wt % spandex; and most preferably the fabric shell is four-way stretch fabric of about 94% wt % cotton and 6% wt % spandex.

As an option, the ergonomic swaddling garment of the invention may have a seat belt accepting means that is a slit or loop or the equivalent.

While the fabric of the garment may be any non-flexible or flexible elasticized material selected from the group consisting of: nylon, rayon, polyester, cotton, linen, canvas, plastic, wool, heat conductive fabrics, porous light-permeable fabrics, antimicrobial fabrics, and combinations or blends thereof, it is understood that cotton/spandex blended retractable fabrics are especially preferred.

The head end of the garment defines an interior volume for receiving the arms of an infant and the foot end defines an interior volume for receiving the legs of an infant, wherein the head end interior volume and the foot end interior volume are approximately equivalent volumes; and the mid section for receiving the trunk of an infant defines an interior volume less than the head and food end volumes thereby providing a distinctive peanut-like ergonomic shape to the garment. The peanut-like shape is essentially maintained in embodiments providing swaddling and either arm movement or leg movement accommodating individual infant preferences or growth and maturity adaptation.

The invention discloses a method for providing ergonomic swaddling to an infant by providing to an infant a swaddling garment as defined herein. The method employs a fabric shell of the garment that is preferably two-way or four-way stretch fabric of cotton in an amount from about 50 wt % to about 98 wt % and spandex in an amount from about 2 wt % to about 98 wt %; an especially preferred fabric shall is four-way stretch fabric of 94 wt % cotton and 6 wt % spandex.

In a method of the invention the head end of the garment defines an interior volume for receiving the arms of the infant and the foot end of the garment defines an interior volume for receiving the legs of an infant, wherein the head end interior volume and the foot end interior volume are approximately equivalent volumes; and the mid section for receiving the trunk of said infant defines an interior volume of the garment less than the head and food end volumes thereby providing a distinctive peanut-like ergonomic shape to the garment. Some accommodations to the peanut-like shape are made in multifunctional garments providing swaddling in combination with either arm movement or leg movement.

In a method of the invention light-permeable net-like fabrics, preferably with a porosity permitting 50-99% light penetration, may be used to provide swaddling for infants undergoing light therapy for the treatment of infant jaundice.

Fabrics that provide antimicrobial characteristics, either naturally or from treatment of fabrics with antimicrobial compositions may be used in garments of the invention.

As used herein, the term "retractable" is the term is used to describe fabrics (i.e., cotton/spandex fabrics and the like) that stretch and then retract or fully return to their pre-stretch shape.

Unless otherwise defined, all technical and scientific terms used herein have the same meaning as commonly understood by one of ordinary skill in the art to which this invention belongs. Although method and materials similar or equivalent to those described herein can be used in the practice or testing of the present invention, preferred methods and materials are described below. All publications, patent applications and other references mentioned herein are incorporated by reference in their entirety. In the case of conflict, the present specification, including definitions, will control. In addition, the materials, methods and examples are illustrative only and not intended to be limiting.

The invention discloses a multifunctional ergonomic garment for providing swaddling and arm freedom of movement for an infant having an elongate peanut-shaped retractable fabric shell with an outer surface and inner surface opposite the outer surface defining an interior volume for receiving the arms, legs and trunk of an infant therein. The retractable fabric shell has (1) a head end with right and left lateral arm accommodation means consisting of sleeves and non-sleeved openings which provide arm freedom of movement for said infant; (2) a foot end opposite the head end for receiving the infant legs defining an interior volume essentially equivalent to the head end interior volume; (3) a mid section between the head end and the foot end for receiving the trunk of infants that is narrower than the head end and the foot end; (4) a neck opening at the head end for receiving an infant's neck; (5) a reversible closure means accessing the interior volume of the fabric shell extending longitudinally along the central axis of the fabric shell from the head end to the foot end; and (6) a chin protector having a closure means at the head end terminus of the closure means. This garment may also have a means for accepting an automotive seat belt below the foot end of the reversible closure means. The head end lateral arm accommodation means may be either long or short sleeves. The sleeves of this garment may be detachable with a closure means for securing the openings created by the removing of the detachable sleeves. Also, the sleeves of this garment may be reversible and fold or tuck inward with a closure means for securing the inwardly folded sleeves. The retractable shell of these garments is fabricated of a two-way or four-way elasticized stretch fabric of nylon, rayon, spandex, polyester, cotton, linen, canvas, wool, heat conductive fabric, or combinations of these materials. Preferably the retractable fabric shell is stretch fabric of cotton in an amount from about 50 wt % to about 98 wt and spandex in an amount from about 2 wt % to about 98 wt %. More preferably, the fabric shell is four-way stretch fabric of 94 wt % cotton and 6 wt % spandex. The chin protector closure may be a toggle closure, hook and loop closure, elastic closure or a snap closure.

The invention also describes an ergonomic garment for providing both swaddling and leg freedom of movement for an infant. This embodiment has an elongate retractable fabric shell with an outer surface and inner surface opposite the outer surface defining an interior volume for receiving the arms, legs and trunk of an infant. The shell of this embodiment has (1) a head end for receiving the arms of an infant; (2) a foot end opposite the head end with leggings for receiving the legs of the infant which provide leg freedom of movement for the infant; (3) a mid section between the head end and the foot end for receiving the trunk of the infant that is narrower than the head end and the foot end; (4) a neck opening at the head end for receiving the neck of the infant; (5) a reversible closure means accessing the interior volume of the fabric shell extending longitudinally along the central axis of the fabric shell from the head end to the foot end; and (6) a chin protector having a closure means at the head end terminus of the closure means. This garment embodiment may have a loop or other means for accepting an automotive seat belt below the foot end of the reversible closure means. In addition the foot end leggings may be detachable with a closure means for securing the openings created by the removing of the detachable leggings. When the legging opening is closed, the garment is peanut-shaped where the foot end defines an interior volume essentially equivalent to the interior volume defined by the head end. Also, foot end leggings of this embodiment may be reversible and fold or tuck inward with a closure means for securing the inwardly foldable leggings thereby giving a peanut-shaped garment where the foot end defines an interior volume essentially equivalent to the interior volume defined by the head end. As with the arms free embodiments, the retractable shell or this embodiment is fabricated from a two-way or four-way elasticized stretch fabric of: nylon, rayon, spandex, polyester, cotton, linen, canvas, wool, heat conductive fabric, or combinations of these materials. Preferably the retractable fabric shell is a stretch fabric of cotton from about 50 wt % to about 98 wt and spandex from about 2 wt % to about 98 wt %. More preferably the fabric shell is four-way stretch fabric of 94 wt % cotton and 6 wt % spandex. The chin protector closure may be a toggle closure, a hook and loop closure, an elastic closure or a snap closure.

The invention also discloses various convertible multifunctional ergonomic garments that provide swaddling and leg and arm freedom of movement for an infant. These convertible garments have an elongate retractable fabric shell having an outer surface and inner surface opposite said outer surface defining an interior volume for receiving the arms, legs and trunk of an infant. The shell has: (1) a head end with right and left arm means that are long or short sleeves or sleeveless openings with closure means providing arm freedom of movement for said infant; (2) a foot end opposite the head end with leg openings with closure means for receiving the legs of an infant thereby providing leg freedom of movement for the infant; (3) a mid section between the head end and the foot end for receiving the trunk of the infant that is narrower than the head end and the foot end; (4) a neck opening at the head end for receiving the neck of the infant; (5) a reversible closure means accessing the interior volume of the fabric shell extending longitudinally along the central axis of the fabric shell from the head end to the foot end; and (6) a chin protector having a closure means at the head end terminus of the closure means. These convertible garments may also have a loop or other means for accepting an automotive seat belt below the foot end of the reversible closure means extending longitudinally along the central axis of the fabric shell. The foot end leg openings have leggings. The foot end leggings and the head end with lateral sleeves or sleeveless openings may be reversible, fold or tuck inward, and can then be secured with a closure means. When the head and food regions are closed, the garment has a distinctive peanut-shape where the foot end defines an interior volume essentially equivalent to the interior volume defined by the head end. The foot end leggings and the head end sleeves may be detachable. The openings created by detachment of leggings and sleeves may be secured with a closure means. When the leggings and sleeves are detached and closed, the garment is a peanut-shaped swaddling garment where the foot defines and interior volume essentially equivalent to the interior volume defined by the head end. These convertible garments have retractable shell that is a two-way or four-way elasticized stretch fabric of nylon, rayon, spandex, polyester, cotton, linen, canvas, wool, heat conductive fabric, or suitable combinations of these materials. Preferably the retractable fabric shell is a stretch fabric of cotton of about 50 wt % to about 98 wt and spandex in an amount from about 2 wt % to about 98 wt %. More preferably, convertible garments are made of a fabric that is four-way stretch fabric of 94 wt % cotton and 6 wt % spandex. The chin protector closure is a toggle closure, a hook and loop closure, an elastic closure, or a snap closure.

The invention also describes a method for providing (1) swaddling and arm freedom of movement: (2) swaddling and leg freedom of movement; and (3) swaddling, arm freedom of movement, and leg freedom for an infant by use of garments of the invention.

Other features and advantages of the present invention will be apparent from the following detailed description, and from the claims.

BRIEF DESCRIPTION OF THE DRAWINGS

FIG. 4 is a schematic front perspective view of a swaddling garment of the invention permitting arm movement.

FIG. 5 is a schematic side perspective view illustrating sleeve closure means applicable to the arms-free embodiment of FIG. 4.

DETAILED DESCRIPTION OF THE INVENTION

Figure 1:
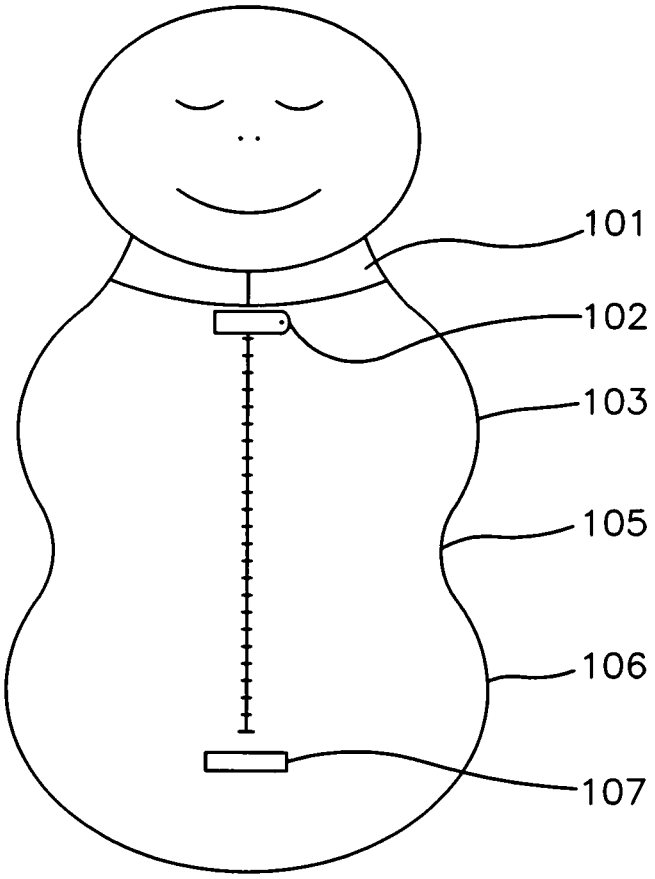
FIG. 1 is a schematic front perspective view of a swaddling garment of invention.

The development of the subject invention began with a concern that the functional and structural characteristics of infants had not been adequately considered in the design of prior art swaddling garments for optimal safety and utility. While today the scientific discipline of ergonomics is routinely concerned with designing according to human needs, the theory, principles and methodology to design in order to optimize human products and system performance is not generally used in the design of infant garments. The present invention has designed novel ergonomic swaddling garments for infants that are compatible with the needs, abilities and limitations of the newborn and their parents or caregivers. There is little question that many clothing and other products used with infants could benefit from redesign based on ergonomic principles. Safety, comfort, ease of use, productivity/performance and aesthetics are five basic aspects of ergonomics that have been employed in the design of the swaddling garments of the present invention. It will readily be appreciated that the swaddling garment designs disclosed herein are consistent with the needs of the infant and the demands and requirements of parents or other infant caregivers. Principles of material science, mechanical engineering, physiology, kinesiology, physiology and psychology have been incorporated into the subject ergonomic swaddling garments. For example, the need for focused garment countervailing containment forces against the movement of infant's arms and legs to effect swaddling in concert with the lesser abdominal forces was instrumental in determining the novel peanut-like shape of the garments of the invention. Ergonomic swaddling can still be maintain in multifunctional garments providing swaddling in addition to either arm movement or leg movement.

It is common pediatric knowledge that many babies wake up frequently during the night exhibiting what is known as the startle reflex, or from self scratching or feeling insecure. Swaddling has been a remedy promoting more restful sleep and feelings of security in infants for hundreds of years. Current designs do not stay intact throughout the night, lose their durability, or otherwise compromise functionality.

Fabric: Stretch Fabric. The ergonomic swaddling garments of the invention have several key distinguishing characteristics. Various types of fabric may be used, including but not limited to nylon, ripstop nylon, rayon, polyester, cotton, fleece, wool, linen, canvas or various blends thereof, including addition of rubber or other elasticized materials. Stretch material, two-way or four-way stretch or retractable material is employed. Four-way stretch material is an especially preferred embodiment. This fabric will both stretch and breath (allow appropriate air exchange between the infant and the ambient environment). Cotton/spandex blends are preferred and may have a cotton range from about 50 wt % to about 98 wt % and a spandex range from about 2 wt % to about 98 wt %. An especially preferred material is four-way stretch material comprising 94% cotton and 6% spandex. Spandex or elastane is a synthetic fiber with exceptional elasticity. Lycra is one brand name for spandex. The use of four-way stretch material that can maintain structural integrity by re-conforming after stretching allows infants to have a normal range of motion in a womb-like environment thereby promoting and enhancing motor development while maintaining an effective swaddle. Multi-directional expandable fabric in concert with other design characteristics provides exception swaddle benefits.

Fabric; Multi-Layer & Fabric Combinations; Heat Conductive Fabrics; Anti-Microbial Fabrics; Net-Like Fabrics for Infant Jaundice Treatment. It is understood that the preferably retractable fabrics of the various garment embodiments of the invention may optionally be multi-layer (i.e., with outer shell fabric lined wholly or in part with fleece or other materials) providing enhanced benefits of comfort, strength, durability, aeration or the like.

Figure 11:
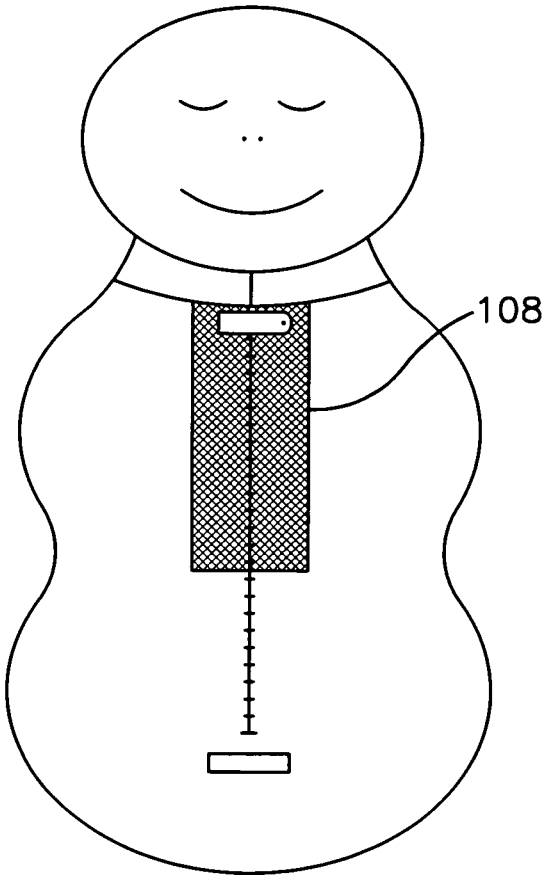
FIG. 11 is a front elevational view of a swaddling garment in accordance with the present invention formed, at least in part, from a net-like material.

FIG. 11 schematically illustrates a peanut-shaped swaddling garment in accordance with the present invention formed, in part, from a net-like fabric (e.g., mesh) designated by reference numeral 108.

Heat conductive fabrics are weavable yarns whose fibers are metallic or have a heat conducting, metallized coating. These fabrics are woven together with a plurality of yarn layers using, for example, an angle weave to produce an interlocked, multilayer fabric. These fabrics provide heat conduction paths for the efficient transferring of heat from a substrate. Such fabrics are variously described as thermal conductive fabrics, heat conductive fabrics or heat generating fabrics.

Infant jaundice, a yellow discoloration of skin & eyes, is a relatively common occurrence with newborns, particularly with infants that are premature or born before thirty six weeks of gestation. The yellow coloration is due to an excess of bilirubin a yellow-colored pigment of red blood cells. Although an underlying disease may cause jaundice, the most common cause of infant jaundice is usually due to immaturity of the liver and an inability to remove bilirubin from the bloodstream. Bilirubin, the causative agent of the yellow color of jaundice, is a normal waste product when old red blood cells are broken down and replaced by new red blood cells. Light therapy or phototherapy is a common treatment for infant jaundice. Infants are placed under light conditions that emit light in the blue-green portion of the visible light spectrum and filter out the invisible ultraviolet wavelengths of light. During treatment, infants wear only diapers and have protective eye patches. The various fabrics of the invention may conveniently be modified to provide porous or net-like weaves that allow light penetration through the fabric to the infant's skin. Light penetration in the range of 50-99% is preferred. Such fabrics are useful to provide benefits of swaddling along with standard light treatment for infant jaundice. The light-porous fabrics must provide sufficient retractability for swaddling and also be sufficiently porous to permit sufficient light permeability for the efficacious treatment of infant jaundice.

In recent years considerable attention has been given to the hazards of bacterial contamination. Examples of concern over bacterial contamination include food poisoning due to pathogenic strains of *Eschericia coli*, and *Salmonella* spp. as well as illnesses and skin infections attributed to *Staphylococcus aureus, Klebsiella pneumonia* and other microorganisms. Antimicrobial wash-stable textiles are known. For example, the common antimicrobial compound triclosan can be co-extruded with acrylic and/or acetate fibers. Silver-containing antimicrobial agents, as well as other antimicrobial agents, can be applied to various fabrics. In order to prevent or treat bacterial or other microbial dermatological or systemic infections, the various fabrics of the invention may be made of fabrics that are treated with antimicrobial compositions (i.e., antibiotics, natural or organic extracts, etc.) or made of fabrics that are naturally antimicrobial (i.e., bamboo, etc.).

Shape. A novel feature of the invention is its ergonomic peanut-like design. This design corresponds to the fabric requirements for optimum swaddling in response to the forces and loads that will be applied by an infant's arms, legs, and midsection during normal newborn activities.

As illustrated in some of the drawings, the bottom of the foot end of the elongate shell is generally arcuate in configuration.

Effectiveness. The ergonomic swaddle garments of the invention prevent Startle Reflex, prevent face scratching, keep hands and feet away from the face or pacifier, promote infant comfort and security, securely contain infants, will not unravel or otherwise lose swaddle functionality, allow infants to move naturally, and prevents overheating that can be caused by over-wrapping infants using blankets, permits easy diaper change, can be used for strollers or when breastfeeding, conforms naturally to the infants, provides stretchy and breathable material construction, and is especially easy to use.

Safety. The ergonomic swaddle garments of the invention will not unravel or ride up over infant's face thereby preventing potential blanket suffocation. Also, the swaddling garments of the invention will not overheat infants due to overwrapping. Overheating is a factor that may contribute to Sudden Infant Death Syndrome (SIDS).

Ease of Use. The disclosed ergonomic swaddle garments are conveniently used by parents of caregivers. In a preferred embodiment, the garment is unzippered, the baby is place in the garment, and then the garment is zippered.

Figure 3:
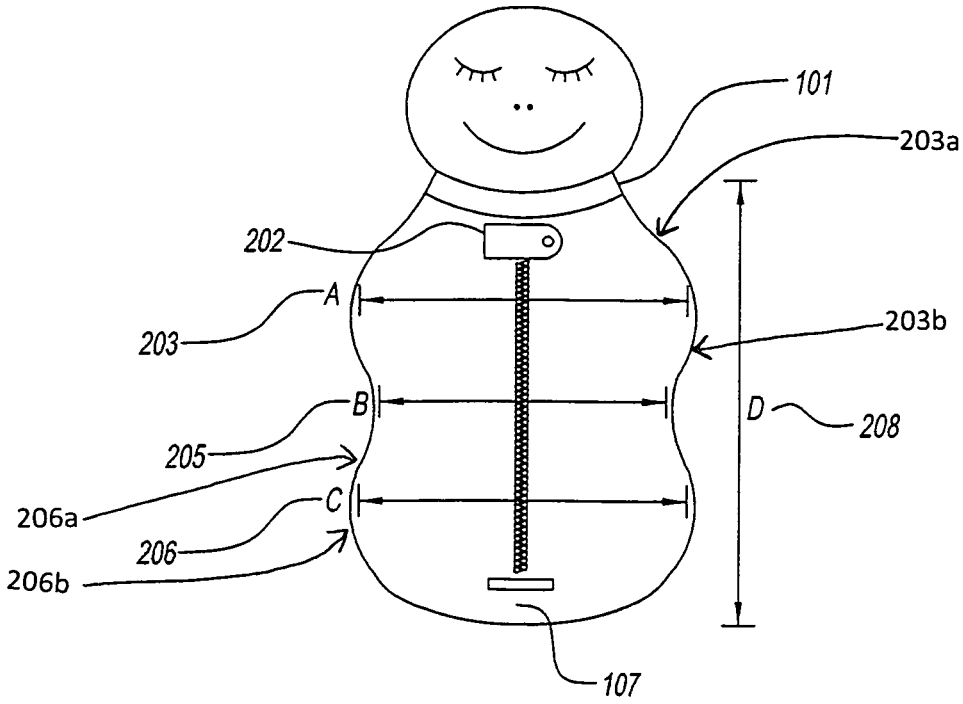
FIG. 3 is a schematic front perspective view of a swaddling garment of the invention illustrating dimensions.

Closures. The ergonomic swaddle garments of the invention in preferred embodiments have a front centrally located zipper as illustrated in FIGS. 1 and 3. Different sizes and types of zippers of various materials (i.e., nylon; plastic, etc.). It is understood that other types of front closures (i.e., Velcro® or hood and loop, snaps, toggles, elastics, etc.), but use of a zipper that is sewn, fused or otherwise secured to the base stretch fabric is especially preferred. The zipper may be one-way or two-way reversible, which will allow for the infant to have a diaper changed without removing the baby from the swaddle garment.

Variations of Ergonomic Peanut-Like Design. As infants grow and mature, there is a need to transition from complete swaddling to partial swaddling where freedom to move either arms or legs individually or to move both arms and legs. In this transition, infants may prefer freedom to move arms for sleeping or during waking hours while still maintaining swaddling of torso and legs. Alternatively, transitioning infants may prefer freedom to move legs while maintaining swaddling of torso and arms, or prefer torso swaddling while having freedom to move both arms and legs. Chin flaps may be included on either farms-free, legs-free, or arms and legs free embodiments. Chin flaps are conveniently secured by snaps, hook and loop (i.e., Velcro® closure) button, or other closure means. The chin flab may be composed of any type of protective sort material (i.e., cotton, fleece, etc.). Garment dimensions of variation of the peanut-shaped garments are (a) length variations ranges from about 12 inches to about 40 inches: (b) upper garment width ranges from about 8 inches to about 16 inches: (c) middle garment width ranges from abut 6 inches to about 14 inches; and (d) lower garment width ranges from about 8 inches to about 16 inches. Leg length ranges from about 5 inches to about 26 inches.

Arms-Free Garments. In arms-free swaddling, several embodiments are possible. A swaddling garment of the invention may or may not have sleeves. Sleeves may be either short sleeves or full-length sleeves. The sleeves may be cotton/spandex material as with peanut-shaped complete swaddling garments, cotton, cotton blends, or other materials (i.e., polyester, nylon, rayon, fleece, etc.). Retractable cotton/spandex material is preferred for the torso and leg areas in arms-free swaddling garments, but various combinations of other materials permitting retractable stretching may also be used. Arms-free garments would preferably have a zipper closure (one-way or two-way) from 8 to about 30 inches in length on the front of garments. Closure means other than zippers (i.e., snaps such as Scoville USA snaps, buttons, or hook and loop such as Velcro® closures).

Reversible Arms-Free Garments. Arms-free swaddling garments may be reversible to complete swaddling garments. For example, the sleeves may have attached closure means (i.e., snaps such as Scoville USA snaps, buttons, one or two-way reversible zippers, hook and loop such as Velcro® closures) where the sleeves can be tucked inwardly and then secured by closure means located either on the sleeve or the torso portion of the garment. With a snap closure means, the male snap component could for example be located on the anterior portion of the sleeve or located anterior to the sleeve or adjacent to the sleeve on the torso portion of the garment; and the female snap component in this configuration would be located on the posterior portion of the sleeve or located posterior/adjacent to the sleeve on the torso portion of the swaddling garment. Buttons or hook and loop closures would be similarly located. To convert to an arms-fee swaddling garment to a complete peanut-shaped swaddling garment, the sleeves would be inwardly tucked and then secured by closing the respective mating components of the respective closure means. Closure means could also be located on a separate fabric flap on or adjacent to the sleeve to conveniently secure the inwardly tucked sleeve and provide the benefit of additional retractable material. In yet another embodiment, the arms themselves can be completely removable from the garments and optionally stored for future use in a pocket storage means attached to the garment.

Legs-free Swaddling Garments. In legs-free embodiments of the invention, the objective is to swaddle the upper body (arms and torso) while permitting freedom of leg movement. Such legs-free garments can then be conveniently used in a stroller, baby swing or car seat where use of infant car seats is permitted. The legs may be foot shaped or sock shaped with retractable fabric preferred (i.e., cotton/spandex) but with the possible use of additional fabrics or combinations of fabrics as noted with the arm-free garment embodiments. It is also possible to have detachable legs that can be removed from the garments and stored for future use. Storage of detached legs could be done with a storage pocket conveniently attached to the body of the garment.

Reversible Legs-Free and Arms-Free Swaddling Garments. Embodiments of the invention include garments that may have both reversible arms-free and legs-free components thereby providing arm movement freedom, leg movement freedom, or both arm and leg movement freedom. Closures and materials of these multifunctional garments are as noted above with arms-free or legs-free embodiments. With reversible embodiments of the invention, the basic peanut-shape swaddle configuration permits embodiments where the lower or bottom peanut is converted to legs and to when desired convert back to the basic peanut-shaped swaddle garment. Similarly, the basic peanut-shaped swaddle garment can be configured to a reversible garment for arm movement which can conveniently be returned to the basic peanut-shaped garment.

Detachable Arms and/or Legs Swaddling Garments. In addition to reversible legs-free and/or arms-free embodiments of swaddling garments of the invention, the arms or leg components (sleeves and leggings) may be completely removable (c.f., FIG. 8) as an alternative to inward folding (c.f., FIG. 4). The removable sleeves and/or leggings may be stored for future use in an optionally attached pocket means or separately stored.

Figure 2:
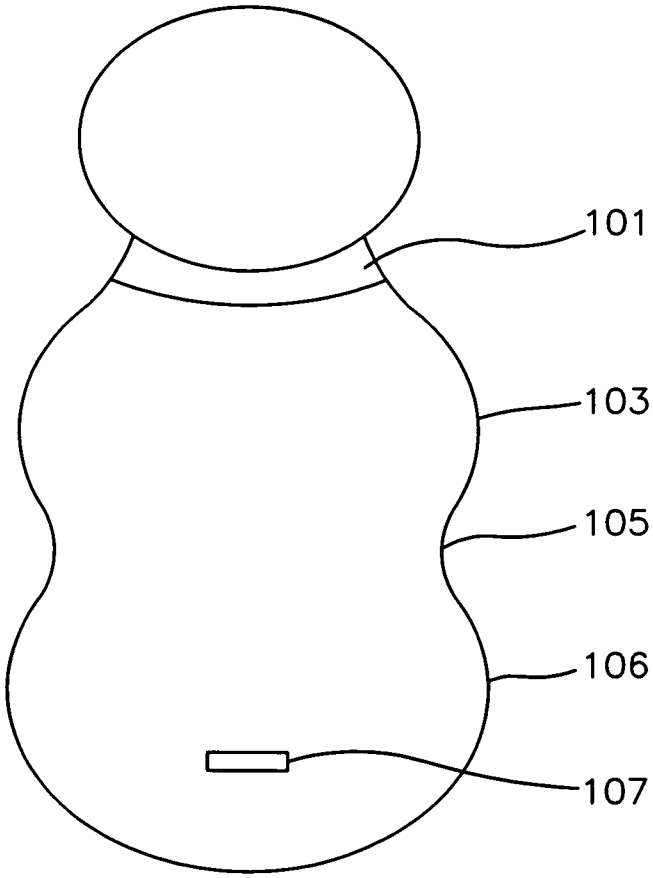
FIG. 2 is a schematic back perspective view of a swaddling garment of the invention.

A swaddling garment incorporating the present invention is shown in FIGS. 1, 2, and 3. Referring now to FIG. 1, there is shown a schematic front perspective view of a swaddling garment of the invention. Shown is a collar 101, a chin protector or closure, 102, a shoulder or head end width region 103, a zipper 104, a middle abdomen or mid section width region 105, and a bottom or foot end width region 106. The shoulder width region 103, the middle abdomen width region 105, and the bottom width region 106 collectively define the ergonomic peanut-like shape of the swaddling garment. The single unit is, in a preferred embodiment, made of four-way flexible multi-directional expandable stretch material that permits the infant to have a normal range of motion for developmental purposes while maintaining an effective swaddle that mimics the infants ability to move and stretch in the womb. 104.

Referring now to FIG. 2, shown is a schematic back perspective view of a swaddling garment of the invention. This view shows a collar 101, the shoulder width region 103, the middle abdomen width region 105, the bottom width region 106, and a seat belt loop 107. The seat belt loop 107 is an optional feature. As illustrated in FIG. 1, the shoulder width region 103, the middle abdomen width region 105, and the bottom width region 106 collectively define the ergonomically designed peanut-like shape of the swaddling garment.

Referring now to FIG. 3, shown is schematic front perspective view of a swaddling garment of the invention illustrating locations of dimensions that are listed in detail in Table 1 herein below.

TABLE 1

| | Original Newborn | Newborn long | Big baby | Mega baby |
|---|---|---|---|---|
| A Shoulder to shoulder width | 8.5" | 8.5" | 10" | 11.5" |
| B Mid width (waist) | 7" | 7.5" | 8.5" | 10" |
| C Bottom width | 8.5" | 8.5" | 10" | 11" |
| D total length | 16" | 22" | 26" | 28" |
| E Zipper length | 12" | 14" | 18" | 20" |

TABLE 1-continued

| | Original Newborn | Newborn long | Big baby | Mega baby |
|---|---|---|---|---|
| F Chin Protector/optional | 2.25" w × 1.25 h | 2.25" w × 1.25 h | 2.25" w × 1.25" h | 2.25" w × 1.25" h |
| G Seatbelt slit/optional | 2" wide | 2" wide | 2" wide | 2" wide |

Shown in FIG. 3, with dimensions detailed in Table 1, is a collar 101, a chin protector or closure 202, the shoulder width region 203, the middle abdomen width region 205, the bottom width region 206, a seat belt loop 107, and length 208.

As also shown in FIG. 3, the upper head portion 203 tapers inwardly and upwardly from the maximum width A in a generally curved configuration as designated by reference numeral 203*a*, and also tapers inwardly and downwardly in a generally curved configuration from the maximum width section A as designated by reference numeral 203*b*. Similarly, the lower foot portion 206 tapers inwardly and upwardly from the maximum width section C in a generally curved configuration designated by reference numeral 206*a*, and also tapers inwardly and downwardly from the maximum width section C in a generally curved configuration designated by reference numeral 206*b*. The mid section 205 is disposed between the downwardly tapering portion 203*b* of the head portion and the upwardly tapering portion 206*a* of the foot portion. The minimum width section B of the mid section 205 is essentially equidistantly spaced between the maximum width section A of the head portion and the maximum width section C of the foot portion in a longitudinal direction. The swaddling garment illustrated by FIG. 3 includes no external adjustment elements for adjusting the size (width, length or volume) of the garment when an infant is received therein.

Referring now to FIG. 4, shown is a schematic perspective view of a swaddling garment of the invention permitting freedom of arm movement. FIG. 4A illustrates this embodiment having short sleeves. FIG. 4B illustrates this embodiment with inwardly folded and secured sleeves that provides a swaddling garment that is, in this configuration, functionally equivalent to the embodiment illustrated in FIGS. 1-3 herein. FIG. 4A is a short-sleeved arms-free swaddling garment 403 having short sleeves 401, a collar 101, a chin protector or closure 102, the middle abdomen width region 105, the bottom width region 106, a zipper closure 104 and a seat belt loop 107. FIG. 4B is the swaddling garment 403 of FIG. 4A showing inwardly tucked and secured sleeves 402, a collar 101, a chin protector or closure 102, the middle abdomen width region 105, a shoulder or head end width region 103, the bottom width region 106, a zipper closure 104 and a seat belt loop 107.

Referring now to FIG. 5, shown is a side perspective view of the sleeve portion of the swaddling garment embodiment illustrated in FIG. 5 with two types of possible closure means. FIG. 5A illustrates a short sleeve 401, a collar 101, a snap closure means with a forwardly located male component 501 and a rearwardly located female receptor component 502. FIG. 5B shows the sleeve portion of the swaddling garment with snap closure of FIG. 5A with the sleeve folded inward and the snap closure means in the closed position 504.

FIG. 5C illustrates a side perspective view of the sleeve portion of the swaddling garment of FIG. 5 with a collar 101 and a forwardly located flap type closure 503 having a male snap component 501 and a rearwardly located female snap component 502. FIG. 5D shows the sleeve portion of a swaddling garment with the flap type snap closure 503 of FIG. 5C with the sleeve folded inward and the snap closure means in the closed position 504.

Figure 6:
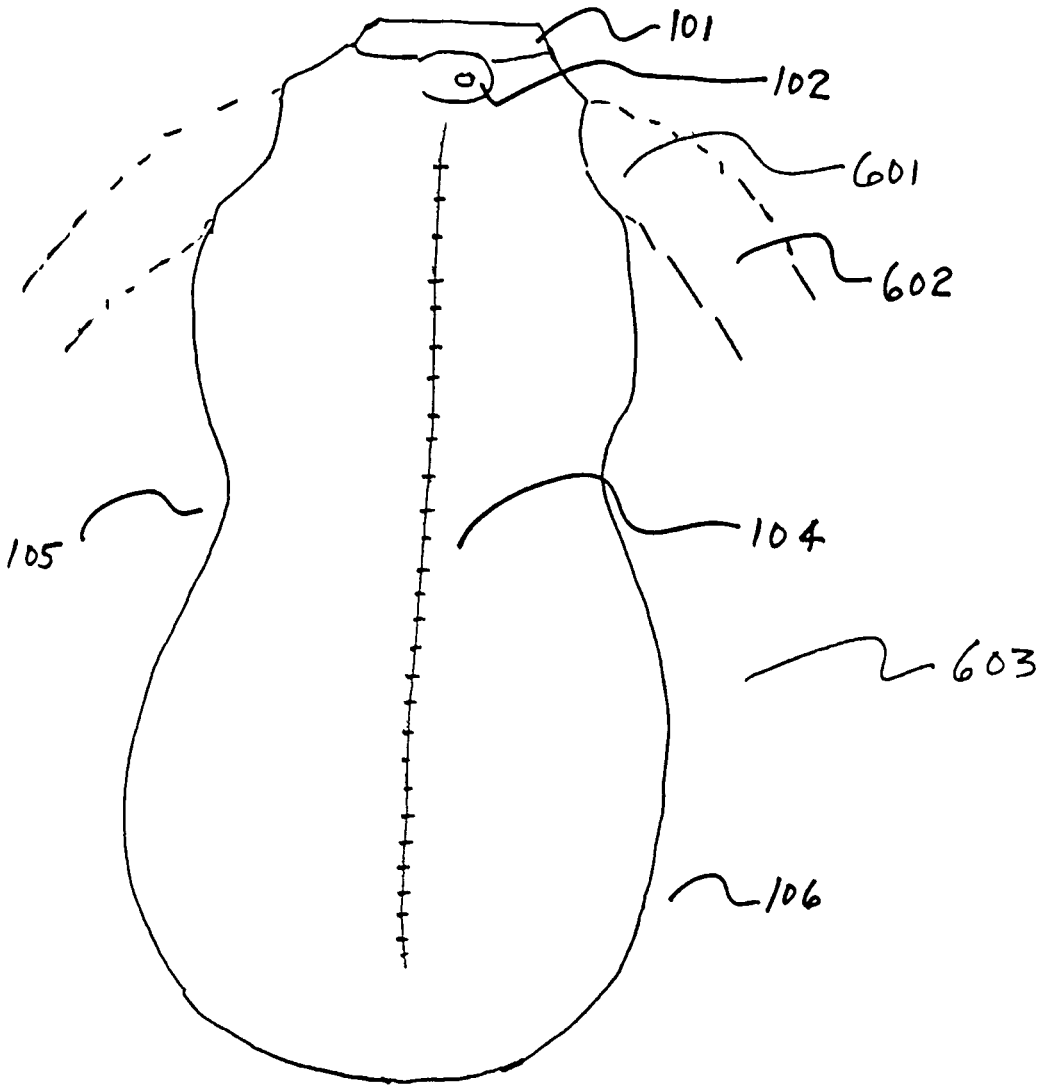
FIG. 6 is a front perspective view of a sleeveless swaddling garment of the invention.

Referring now to FIG. 6, shown is a schematic front perspective view of a sleeveless swaddling garment of the invention permitting freedom of arm movement 603. This arms-fee embodiment 603 shows a collar 101, a chin protector or closure 102, the middle abdomen width region 105, the bottom width region 106, a zipper closure 104, a sleeveless essentially circular arm opening 601, and arm 602 extending through arm opening 601.

Figure 7:
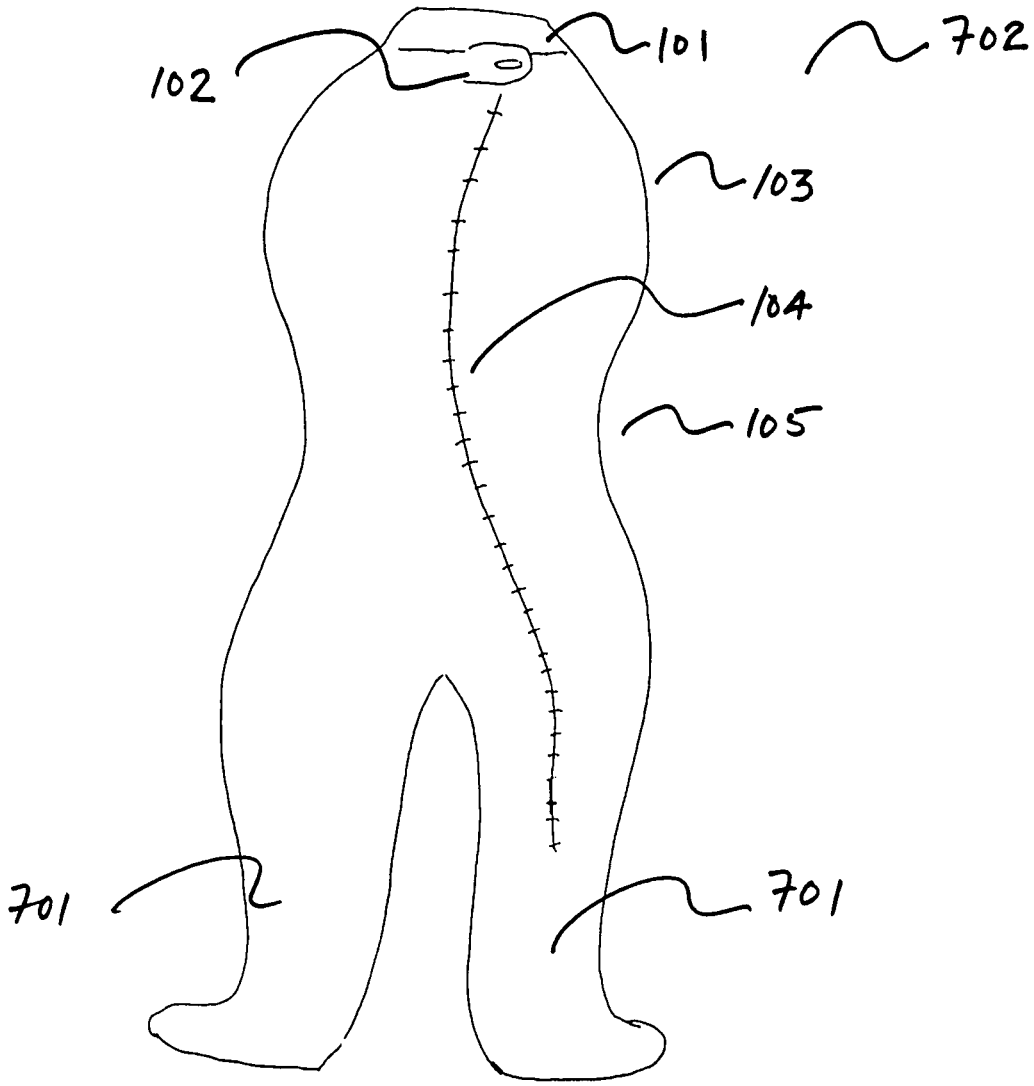
FIG. 7 is a front perspective view of a swaddling garment of the invention with leggings.

Referring now to FIG. 7, shown is a swaddling garment embodiment of the invention with leggings 702. This embodiment with leggings shows a collar 101, a chin protector or closure 102, the middle width region 105 for receipt of an infant's trunk, a shoulder or head end width region 103 for receipt of an infant's arms and upper torso, a zipper closure 104, and legs 701.

Figure 8:
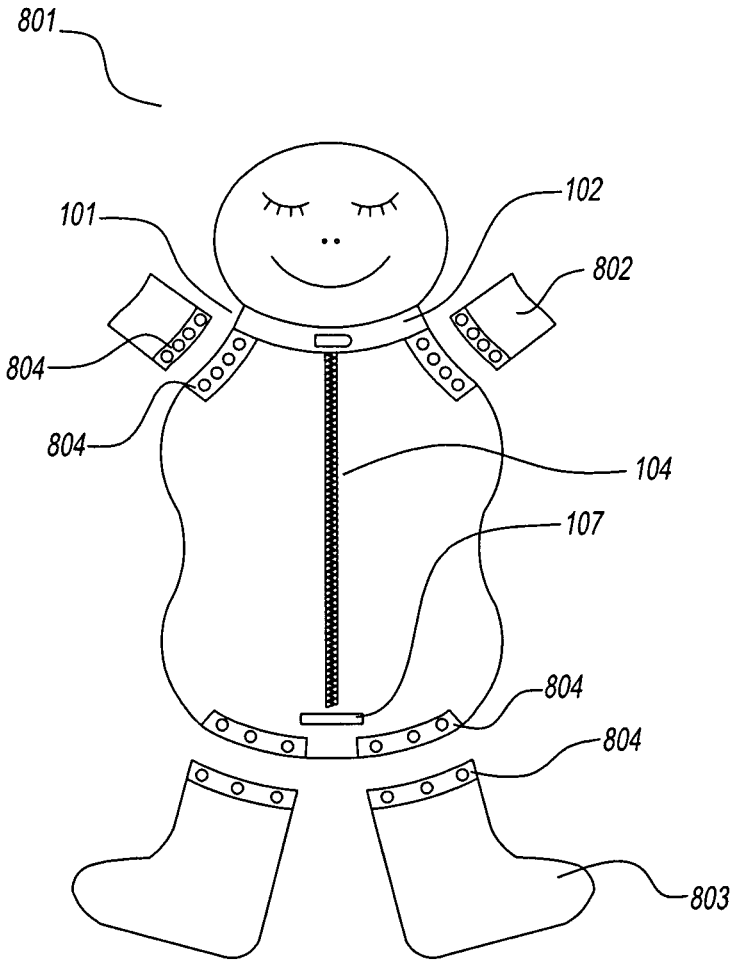
FIG. 8 is a front perspective view of a swaddling garment of the invention with detachable sleeves and leggings.

Referring now to FIG. 8, shown is a swaddling garment 801 of the invention with attachable sleeves 802 that are attached to the body of the garment with snap closures 804. The garment has attachable leg component 803 that is secured to the body of the garment with snap closures 804. Shown also is a centrally located one or two-way zipper 104, a seat belt loop, a collar 101 that has a chin protector or closure 102. The opening left with the detachment of the sleeves 802 or the legs 803 is closed with a closure means i.e., secured by snaps, hook and loop (i.e., Velcro® closure) button, or other closure means.

Figure 9:
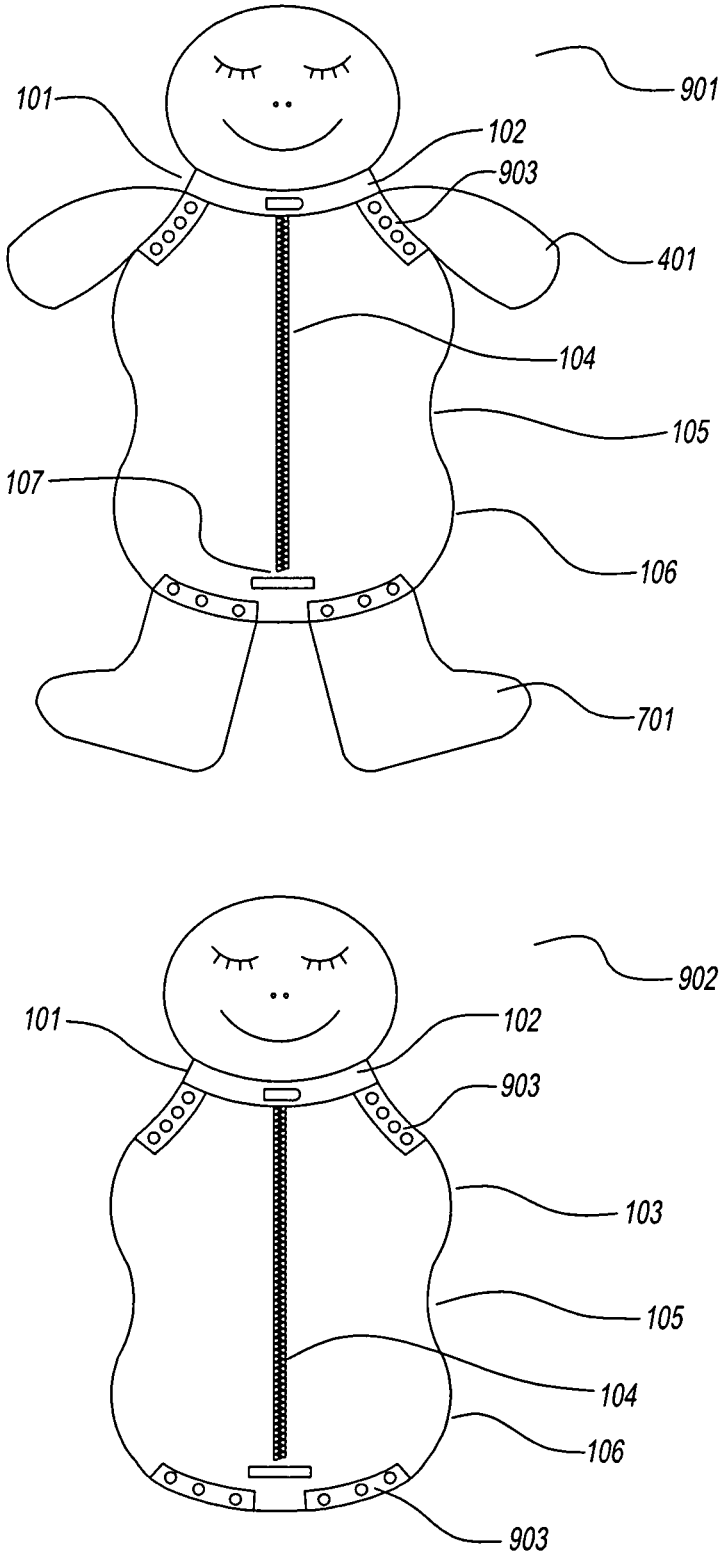
FIG. 9 is a front perspective view a reversible swaddling garment of the invention with retractable sleeves and leggings.

Referring now to FIG. 9, shown is a reversible swaddling garment with attached arms and leggings in the extended position 901 and with arms and leggings folded inward and secured 902. This illustration shows a collar 101 with a chin protector or closure 102, snap closure 903, retractable short sleeve 401, retractable legging 701, a frontal midline zipper closure 104, shoulder or head end garment region 103 for receipt of an infant's arms and upper torso, middle abdominal garment region 105 for receipt of infant's trunk, bottom width garment region 106 for receipt of an infant's legs and lower torso, and seat belt loop 107.

Figure 10:
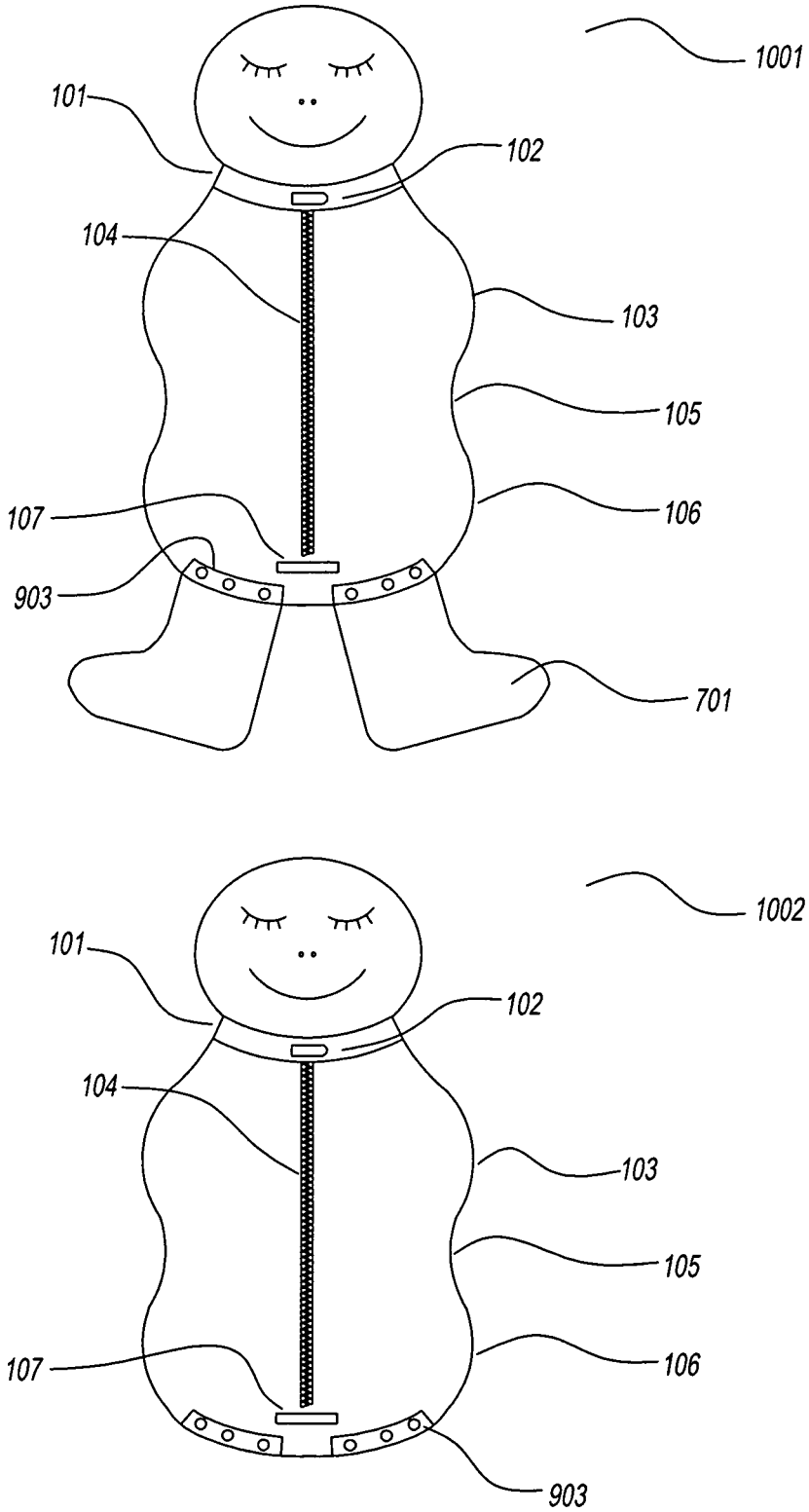
FIG. 10 is a front perspective view of a reversible swaddling garment of the invention with retractable leggings.

Referring now to FIG. 10, shown is a reversible swaddling garment with attached leggings in the extended position 1001 and with leggings folded inward and secured 1002. Illustrated is a collar 101 with a chin protector or closure 102, snap closure 903, retractable legging 701, frontal midline zipper closure 104, shoulder or head end garment region 103 for receipt of an infant's arms and upper torso, middle abdominal garment region 105 for receipt of an infant's trunk, bottom width garment region 106 for receipt of an infant's legs and lower torso, and seat belt loop 107.

Although the present invention describes in detail certain embodiments, it is understood that variation and modifications exist known to those skilled in the art that are within the invention. Accordingly, the present invention is intended to encompass all such alternatives, modifications and variation that are within the scope of the invention as set forth in the following claims.

What is claimed is:

1. A swaddling garment for an infant, said garment comprising:

an elongate peanut-shaped retractable fabric shell having an outer surface and inner surface opposite said outer surface defining an interior volume for receiving arms, legs and trunk of an infant therein:

said shell having no external adjustment elements for adjusting the width and length of the shell when said infant is received therein, an upper head portion for receiving the arms of said infant;

a lower foot portion opposite said upper head portion for receiving the legs of said infant, said lower foot portion having a maximum inner width and an interior volume essentially equivalent to a maximum inner width and an interior volume of said upper head portion;

said head and foot portions of said garment each being generally curved in configuration and each having said maximum inner width between upper and lower ends of said head and foot portions, respectively;

said head portion tapering inwardly from said maximum width of said head portion in both an upper and lower direction in a generally curved configuration;

said foot portion tapering inwardly from said maximum width of said foot portion in both an upper and lower direction in a generally curved configuration;

a mid section defined between an inwardly lower tapering part of the upper head portion and an inwardly upper tapering part of the lower foot portion, the mid section having a minimum inner width less than the maximum inner width of each of said upper head portion and said lower foot portion, respectively; said mid section having an interior volume less than the interior volume of either said upper head portion and said lower foot portion; said minimum inner width of said midsection being disposed essentially equidistantly between the maximum inner width of the upper head portion and the maximum inner width of the lower foot portion in a longitudinal direction; said mid section and said upper head portion and said lower foot portion providing said elongate shell of said garment with said peanut shape;

a neck opening at the head portion for receiving a neck of said infant; and a reversible closure means for accessing said interior volume of said fabric shell.

2. A garment according to claim 1 having a means for accepting an automotive seat belt below said reversible closure means.

3. A garment according to claim 1, wherein said retractable shell is a two-way or four-way elasticized stretch fabric selected from the group of fabrics consisting of:

nylons, rayons, spandex, polyesters, cottons, linens, canvas, wools, heat conductive fabrics, and combinations or blends thereof.

4. A garment according to claim 1, wherein said fabric shell is stretch fabric of cotton in an amount from about 50 wt % to about 98 wt and spandex in an amount from about 2 wt % to about 98 wt %.

5. A garment according to claim 1, wherein said fabric shall is four-way stretch fabric of 94 wt % cotton and 6 wt % spandex.

6. A garment according to claim 1, wherein said shell is formed, at least in part, from a mesh material.

7. A garment according to claim 1, further including a chin protector provided below said neck opening.

8. A garment according to claim 1, wherein said lower foot portion has a bottom which is arcuate in configuration.

* * * * *

UNITED STATES PATENT AND TRADEMARK OFFICE

CERTIFICATE OF CORRECTION

PATENT NO. : 8,607,364 B2
APPLICATION NO. : 12/798590
DATED : December 17, 2013
INVENTOR(S) : Karen H. Barski It is certified that error appears in the above-identified patent and that said Letters Patent is hereby corrected as shown below:

In the Specification

Column 3, Line 7: Delete “food” and substitute --foot--.

Signed and Sealed this
Eighteenth Day of February, 2014

Michelle K. Lee

Michelle K. Lee
*Deputy Director of the United States Patent and Trademark Office*